US006004161A

United States Patent [19]

Roussy et al.

[11] Patent Number: 6,004,161

[45] Date of Patent: Dec. 21, 1999

[54] MALE CONNECTOR ADAPTABLE TO VARIOUS SOCKET DIAMETERS

[75] Inventors: Pascal Roussy, Le Mans; Pascal Jean, Mulsanne, both of France

[73] Assignee: U.S. Philips Corporation, New York, N.Y.

[21] Appl. No.: 08/957,805

[22] Filed: Oct. 24, 1997

[30] Foreign Application Priority Data

Oct. 29, 1996 [FR] France ..... 96 13190

[51] Int. Cl.[6] ..... H01R 17/18

[52] U.S. Cl. ..... 439/668

[58] Field of Search ..... 439/669, 668, 439/265, 270

[56] References Cited

U.S. PATENT DOCUMENTS

| | | | |
|---|---|---|---|
| 5,158,484 | 10/1992 | Chou | 439/668 |
| 5,378,177 | 1/1995 | Froeberg et al. | 439/836 |
| 5,569,053 | 10/1996 | Nelson et al. | 439/668 |
| 5,860,824 | 1/1999 | Fan | 439/265 |

FOREIGN PATENT DOCUMENTS

| | | | |
|---|---|---|---|
| 2293054A | 3/1996 | United Kingdom | H01R 13/62 |

*Primary Examiner*—Khiem Nguyen
*Assistant Examiner*—Michael C. Zarroli
*Attorney, Agent, or Firm*—Dicran Halajian

[57] ABSTRACT

A male connector is disclosed having an adjustable diameter for insertion in a socket. The connector includes an internal sleeve having a rotary sleeve. An external sleeve partially surrounds the internal sleeve and the rotary sleeve. A finger is attached to the external sleeve. In response to a rotation of the rotary sleeve, the finger moves laterally to change the connector diameter. Both the finger and the rotary sleeve do not move longitudinally. The connector further includes a locking device to maintain the rotary sleeve in a desired position. The locking device has a first series of teeth along an outer surface of the internal sleeve for cooperating with a second series of teeth along an inner surface of the external sleeve. In addition, the connector includes a cam having a profile which allows the diameter to change when the finger follows the cam profile in response to the rotation of the rotary sleeve.

17 Claims, 6 Drawing Sheets

[ 1-1 ]

[ 2-2 ]

[ 3-3 ]

[ 1-1 ]

[ 2-2 ]

[ 3-3 ]

MALE CONNECTOR ADAPTABLE TO VARIOUS SOCKET DIAMETERS

BACKGROUND OF THE INVENTION

The invention relates to a male connector for electrically connecting to a socket, notably of the cigarette lighter type of an automotive vehicle, intended to be adapted to various diameters of the socket, comprised between a minimum and a maximum diameter, said male connector comprising:

an internal sleeve, an external sleeve surrounding the internal sleeve, at least one locking finger positioned on the outside of the male connector, a displacement means permitting of radially displacing the locking finger for adapting to the diameter of the socket.

There are a great many electric or electronic appliances, such as electric household appliances, telecommunication equipment, audio apparatus, video apparatus etc., intended to be connected to a socket, notably of the cigarette lighter type of an automotive vehicle. As the diameter of these cigarette lighter sockets is not a standard diameter in the world, it depends on the country in which the vehicle is manufactured. For example, vehicles manufactured in Europe generally have a cigarette lighter socket whose diameter is larger than that of the cigarette lighter sockets of vehicles manufactured in the United States and in Japan.

SUMMARY OF THE INVENTION

A male connector adaptable to various diameters of cigarette lighter sockets is known from patent GB 2293054A. This connector is formed by an inner sleeve and an outer sleeve. The outer sleeve has at least one locking finger admitting of being displaced laterally from an initial position by a displacement means when one of the sleeves slides relative to the other in a longitudinal direction. This displacement then causes the outside diameter of the male connector to augment until the diameter adequate for maintaining said device in the cigarette lighter socket is reached. The adaptation of the male connector to the diameter of the cigarette lighter socket thus results from a longitudinal sliding movement of one sleeve of said device relative to the other, this movement being prolonged insertion or extraction movements of the connector.

This male connector has at least one considerable drawback. In fact, with each insertion/extraction of said connector, the displacement of the locking finger is likely to be changed. Consequently, the adaptation of the diameter of said male connector to the diameter of the socket is to be made again for each new connection.

It is an object of the present invention to largely remedy this drawback and provide a male connector which permits of connecting an electric appliance or an electronic appliance to a socket, notably a cigarette lighter, in a reliable manner, so that the diameter of said connector may be adapted beforehand to the diameter of the socket.

Therefore, a connector of the type defined in the opening paragraph is characterized in that the displacement means is formed by a rotary means for radially extracting at least one part of the locking finger by a relative rotary movement between the inner sleeve and the outer sleeve of the male connector.

This rotary displacement means provides the advantage of being adjustable beforehand to the diameter of the socket to avoid the user having to make this adjustment with each new connection. With this object, there is provided a blocking device of the rotary displacement means for blocking the rotation of one sleeve relative to the other.

Another object of the present invention is to provide a male connector which is less sensitive to any misadjustments caused by multiple insertions/extractions. In fact, the adaptation of the diameter of the male connector according to the invention involving a relative rotary movement between the inner sleeve and the outer sleeve of said connector, the chance that the displacement becomes unsettled during an insertion (extraction, respectively) of said connector in (from, respectively) the socket, is very slim, these insertions/extractions being effected when the longitudinal movements do not need a rotary movement.

These and other aspects of the invention will be apparent from and elucidated with reference to the embodiments described hereinafter.

DESCRIPTION OF THE PREFERRED EMBODIMENTS

Figure 1:
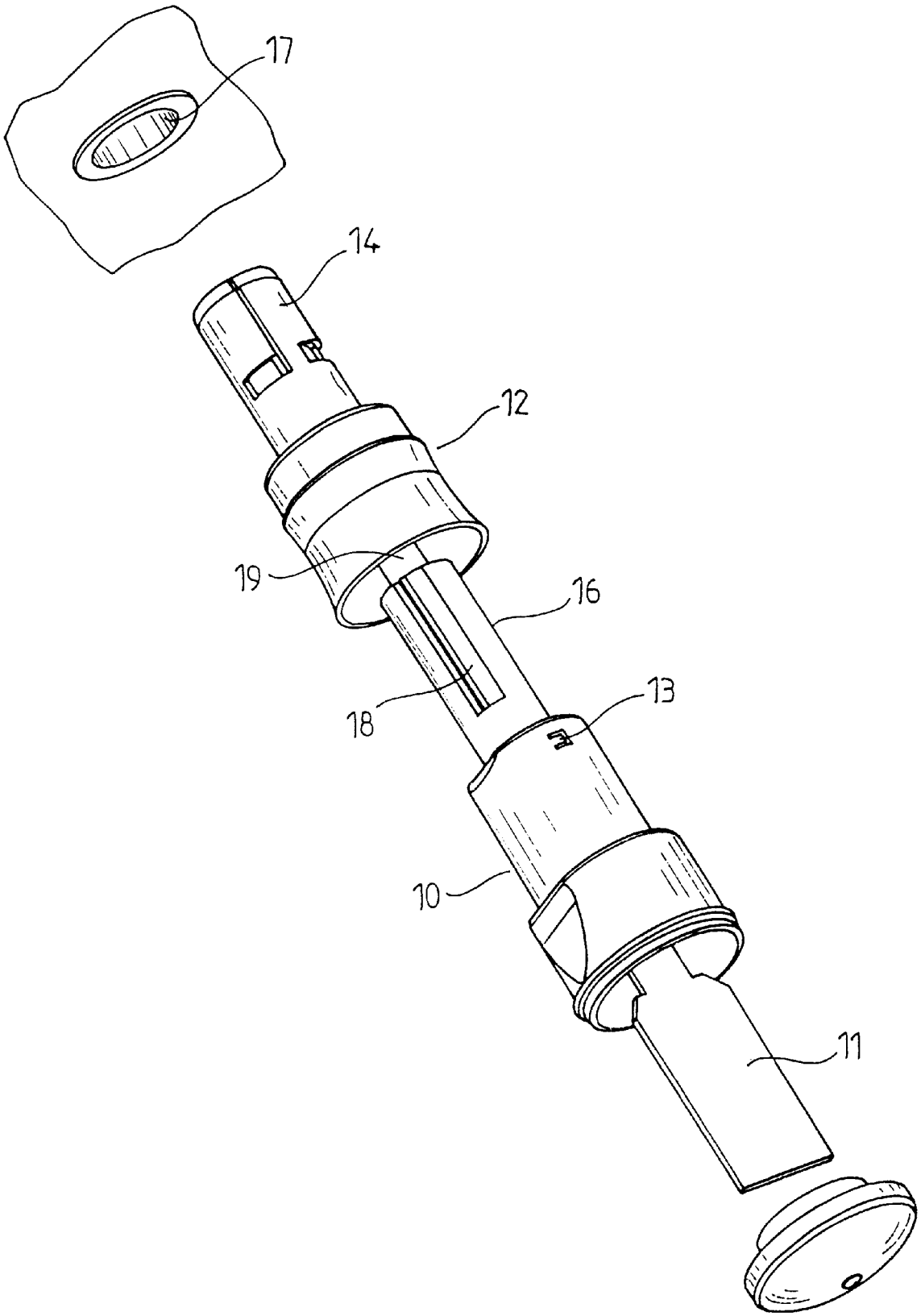
FIG. 1 represents an exploded perspective view of the male connector according to a preferred embodiment of the invention.
Figure 2:
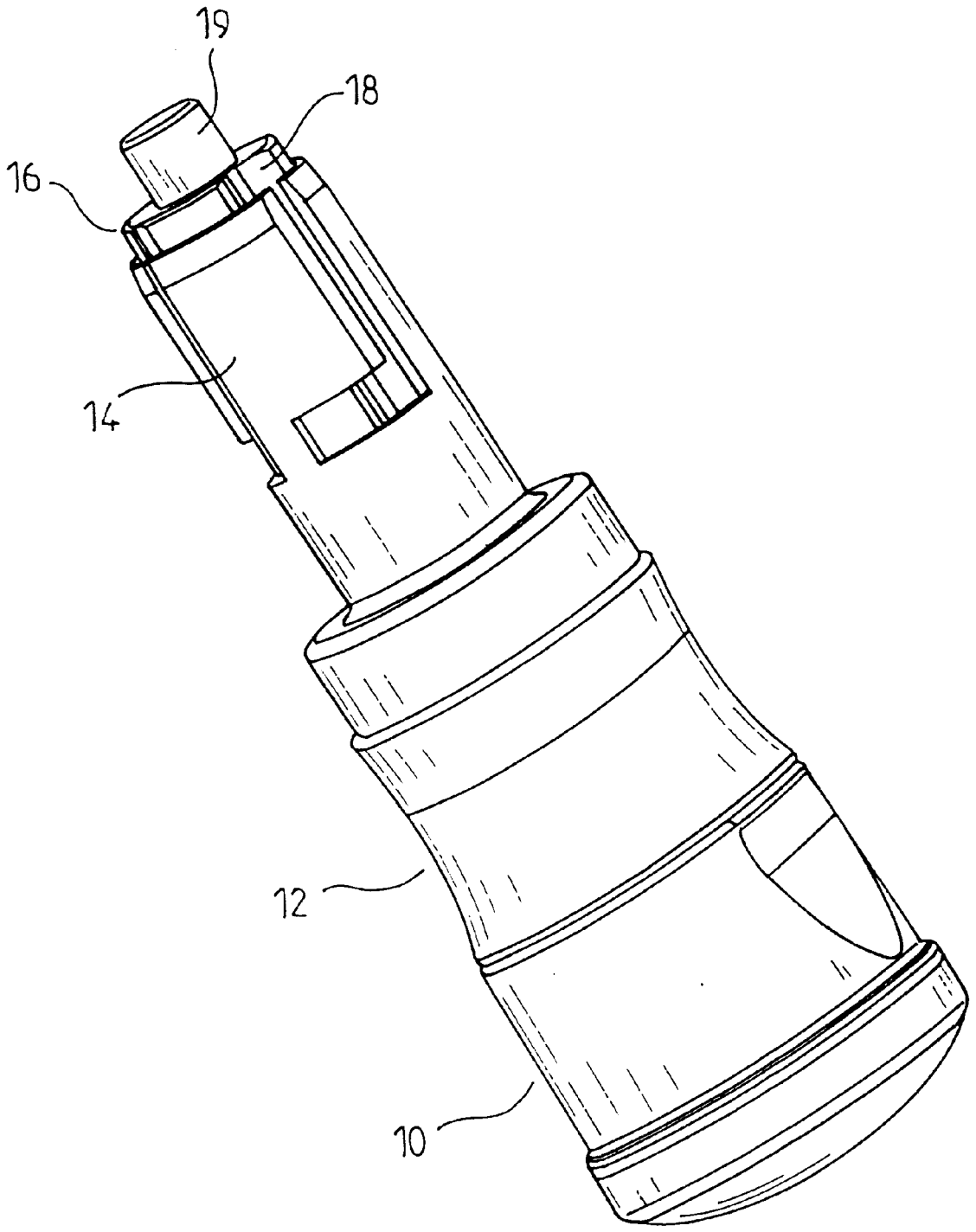
FIG. 2 represents a perspective view of the male connector according to the preferred embodiment of the invention.
Figure 3B:
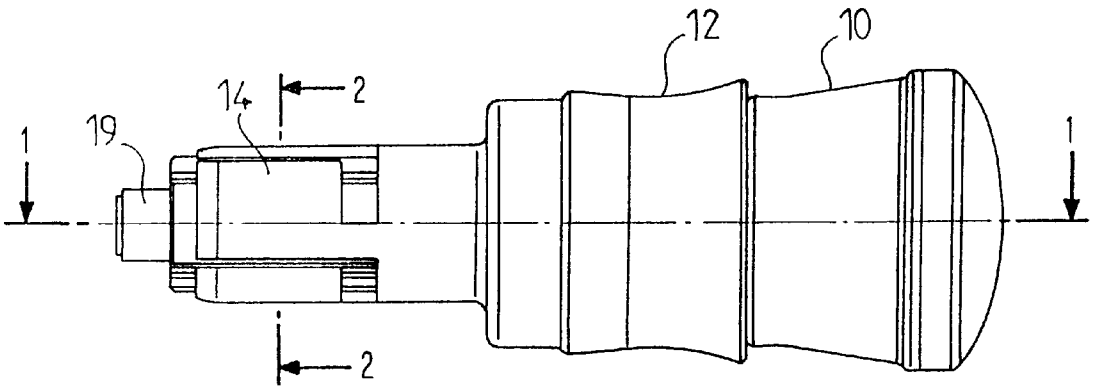
FIG. 3 shows in A, B, C, D and E five views of the male connector according to the preferred embodiment of the invention.
Figure 3D:
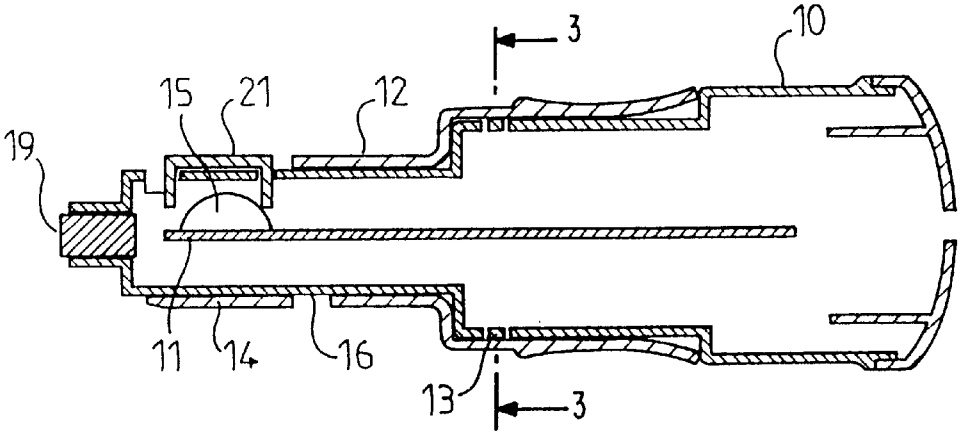
Figure 3A:
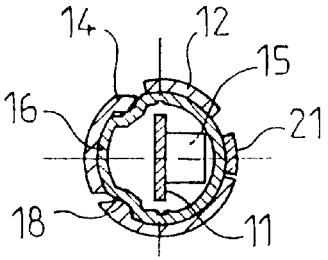
Figure 3E:
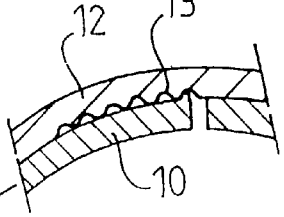
Figure 3C:
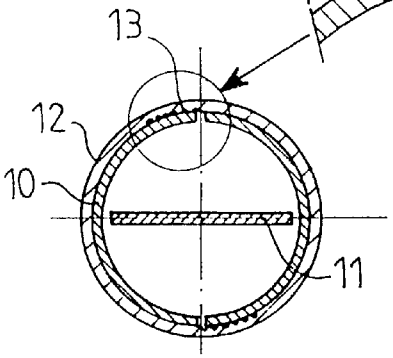
Figure 4B:
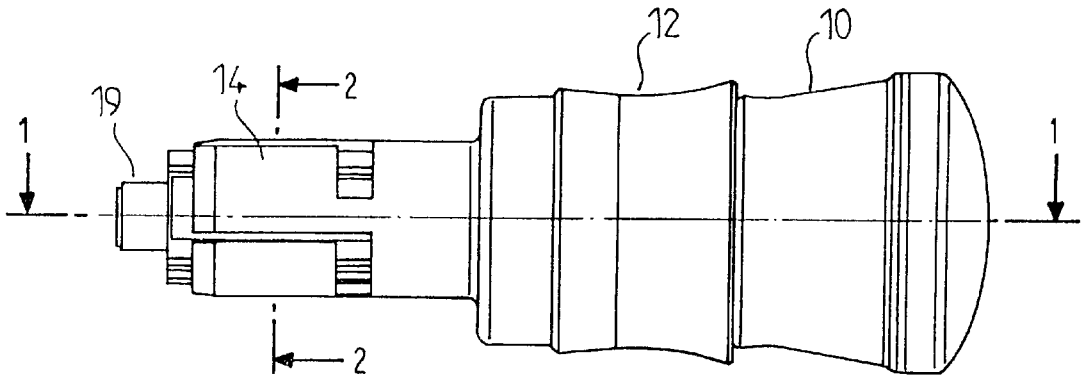
FIG. 4 shows these same views for a different value of the diameter of the socket.
Figure 4D:
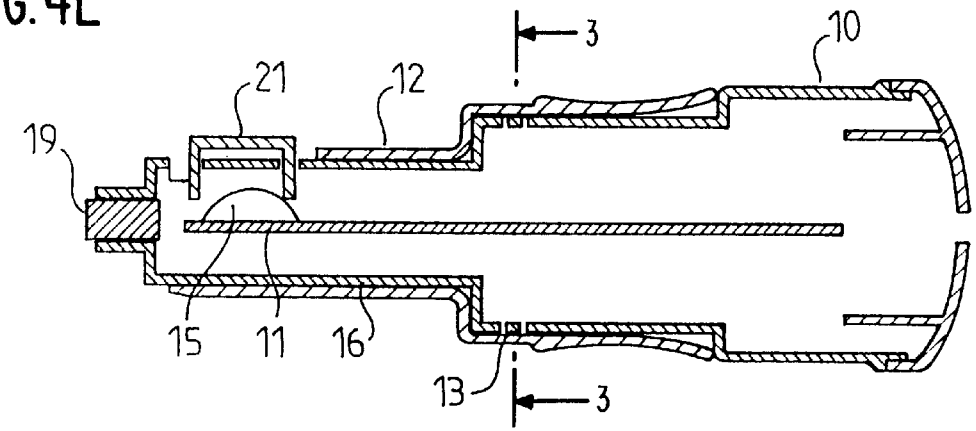
Figure 4A:
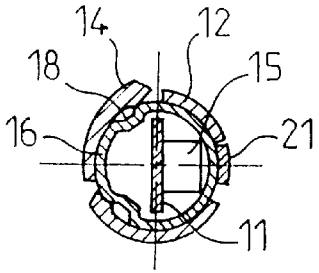
Figure 4E:
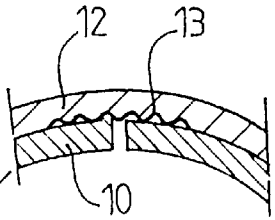
Figure 4C:
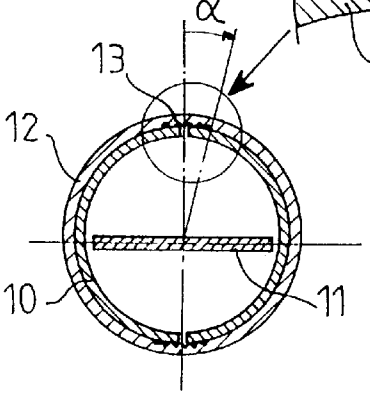

The connector according to a preferred embodiment shown in FIG. 1 comprises an inner sleeve 10, an outer sleeve 12 surrounding the inner sleeve 10, at least one locking finger 14 positioned outside the outer sleeve 12, which locking finger 14 may be conductive. A rotary displacement means 16, firmly attached to the internal sleeve 10, makes it possible to radially remove the locking finger 14 from an initial position during a rotary movement between the inner and outer sleeves 10 and 12, respectively. Therefore, the rotary displacement means 16 comprises a cam element 18 which has a cam profile so that the locking finger 14 which is firmly attached to the external sleeve 12, moves away from its initial position under the influence of the cam element 18, so that the outer diameter of the male connector is adapted to the inner diameter of the socket 17 and they are kept mechanically an electrically in contact after insertion. The end of the male connector comprises an electrically conducting element 19 intended to co-operate with a conducting element of the socket to ensure a first electric contact. A second electric contact is realized by the side walls of the connector and socket. For this purpose, a metallic device 21 is resiliently pressed out of the inner sleeve 10 by a return spring 15 and passes through openings made in said sleeve 10. The printed circuit board 11 ensures the interface between the first and second contacts described above and the electric circuits of the appliance one wishes to connect to the socket 17. According to the selected embodiment, the displacement of the locking finger 14 under the influence of the cam 18 may be obtained by various means. If the natural resilience of the material does not permit of obtaining the desired displacement, a return spring means (not shown) could be provided.

The views in A, B, C and D of FIGS. 3 and 4 make it possible to understand the displacement mechanism of the locking finger 14 when the cam element 18 is rotated relative to the outer sleeve 12.

In FIG. 3, the view shown in A represents a section along the plane [2—2] of the view shown in B. The view shown in D represents a section along the plane [1—1] of the view shown in B. The view shown in C represents a section along the plane [3—3] of the view represented in D. A blocking device 13, formed by a first series of teeth along the outside periphery of the inner sleeve 10, and a second series of teeth along the inner periphery of the outer sleeve 12, is represented in C in FIGS. 3 and 4. This catch blocking means 13 makes it possible to maintain the displacement of the finger 14. An enlargement of the detail of the catch blocking means 13 makes it possible to understand how the sleeves 10 and 12 co-operate during the rotation of the cam 18. FIG. 4 represents the same views as FIG. 3, the sleeves 10 and 12 having made a rotation by an angle $\alpha$ with respect to each other. In FIG. 4 may thus be seen how the finger 14 rises under the influence of cam 18 to vary the diameter of the male connector.

Figure 5:
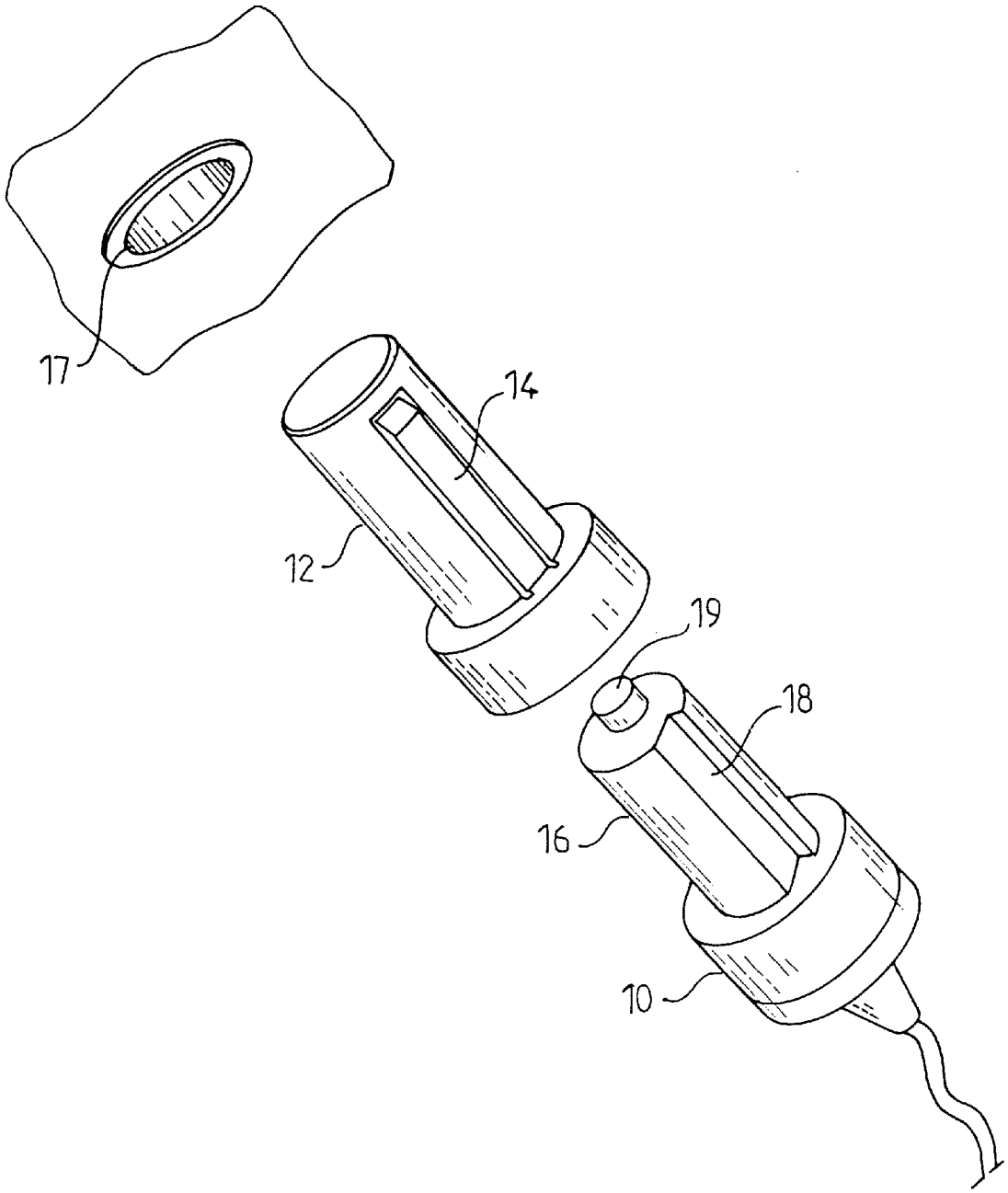
FIG. 5 shows in an exploded perspective view a variant of the preferred embodiment of the invention.
Figure 6:
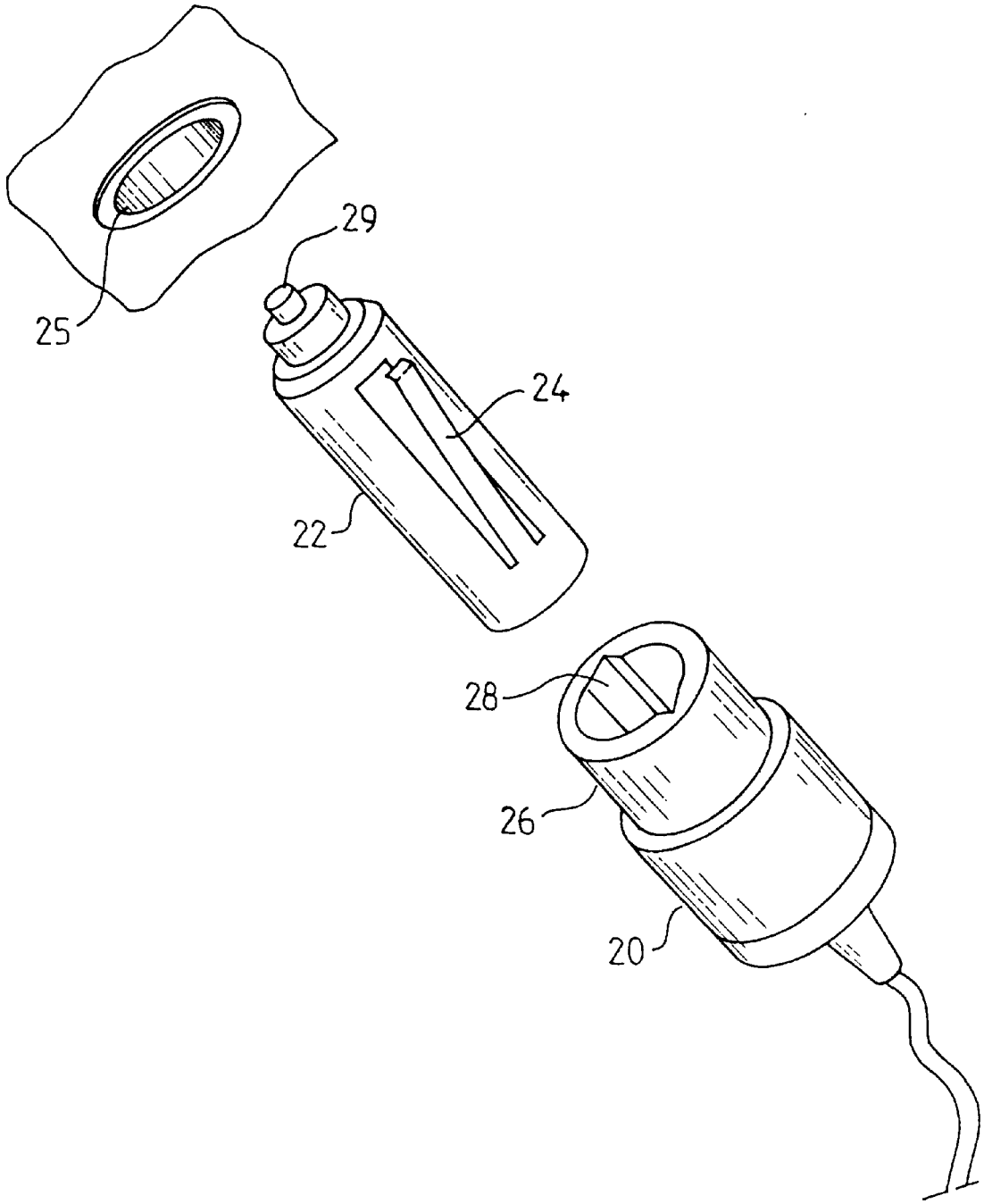
FIG. 6 shows an exploded perspective view of another variant of the preferred embodiment of the invention.

By way of a variant, FIG. 5 shows an embodiment according to the invention, in which the locking finger 14 is disposed longitudinally on the outer sleeve 12. The connector according to another embodiment shown in FIG. 6 comprises the same elements as that represented in FIG. 5, with the exception that the roles of the outer sleeve 20 and inner sleeve 22 are reversed relative to FIG. 5, and that the connector has an additional element, a return spring means (not shown) intended to keep the finger 24 in an initial position forming an angle with the axis of the inner sleeve 22, which corresponds to a maximum diameter of the socket 25. The rotary displacement means 26, which is firmly attached to the outer sleeve 20, has a cam element 28 in contact with which the angle formed by the locking finger 24 and the axis of the inner sleeve 22 diminishes to adapt the male connector to a smaller diameter of the socket.

Consequently, the invention is not restricted to the embodiments that have just been described and shown. Other variants of embodiments of the invention will be obvious to a man of ordinary skill in the art, for example, as regards the form of the locking finger 14, the profile of the cam element 18, or the catch blocking means 13, these variants are not outside the scope of the invention.

We claim:

1. A male connector having a first end for insertion in a socket comprising:

an internal sleeve located near a second end of the male connector;

a rotary sleeve extending from said internal sleeve toward the first end of the male connector;

an external sleeve partially surrounding the internal sleeve and the rotary sleeve; and a finger attached to said external sleeve; wherein said finger moves laterally and does not move longitudinally to change a diameter of said first end in response to a rotation of said rotary sleeve.

2. The male connector of claim 1, wherein said rotary sleeve does not move longitudinally.

3. The male connector of claim 1, further comprising a locking device which locks said rotary sleeve in a desired position.

4. The male connector of claim 3, wherein said locking device includes a first series of teeth along an outer surface of said internal sleeve for cooperating with a second series of teeth along an inner surface of said external sleeve to maintain said rotary sleeve in said desired position.

5. The male connector of claim 1, further comprising a locking device having a first series of teeth along an outer surface of said internal sleeve for cooperating with a second series of teeth along an inner surface of said external sleeve to maintain said rotary sleeve in a desired position.

6. The male connector of claim 1, further comprising a cam having a profile which allows said diameter to change when said finger follows said profile in response to a rotation of said rotary sleeve.

7. A male connector having a first end for insertion in a socket comprising:

an internal sleeve located near a second end of the male connector;

a rotary sleeve extending from said internal sleeve toward the first end of the male connector;

an external sleeve partially surrounding the internal sleeve and the rotary sleeve;

a finger attached to said external sleeve; and a locking device which maintains said rotary sleeve in a desired position;

said finger moving laterally to change a diameter of said first end in response to a rotation of said rotary sleeve.

8. The male connector of claim 7, wherein said locking device has a first series of teeth along an outer surface of said internal sleeve for cooperating with a second series of teeth along an inner surface of said external sleeve.

9. The male connector of claim 7, wherein said finger does not move longitudinally.

10. The male connector of claim 7, wherein said rotary sleeve does not move longitudinally.

11. The male connector of claim 7, further comprising a cam having a profile which allows said diameter to change when said finger follows said profile in response to a rotation of said rotary sleeve.

12. A male connector having an adjustable diameter for insertion in a socket comprising:

an internal sleeve having a rotary sleeve which does not move longitudinally;

an external sleeve partially surrounding the internal sleeve and the rotary sleeve; and a finger attached to said external sleeve; wherein said finger moves laterally to change said diameter in response to a rotation of said rotary sleeve.

13. The male connector of claim 12 wherein said finger does not move longitudinally.

14. The male connector of claim 12, further comprising a locking device which locks said rotary sleeve in a desired position.

15. The male connector of claim 14, wherein said locking device includes a first series of teeth along an outer surface of said internal sleeve for cooperating with a second series of teeth along an inner surface of said external sleeve to maintain said rotary sleeve in said desired position.

16. The male connector of claim 12, further comprising a locking device having a first series of teeth along an outer surface of said internal sleeve for cooperating with a second series of teeth along an inner surface of said external sleeve to maintain said rotary sleeve in a desired position.

17. The male connector of claim 12, further comprising a cam having a profile which allows said diameter to change when said finger follows said profile in response to a rotation of said rotary sleeve.

* * * * *